US006338669B1

(12) United States Patent
Togawa et al.

(10) Patent No.: US 6,338,669 B1
(45) Date of Patent: Jan. 15, 2002

(54) POLISHING DEVICE

(75) Inventors: Tetsuji Togawa; Kuniaki Yamaguchi, both of Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/509,997

(22) PCT Filed: Dec. 28, 1998

(86) PCT No.: PCT/JP98/05992

§ 371 Date: Jun. 15, 2000

§ 102(e) Date: Jun. 15, 2000

(87) PCT Pub. No.: WO99/33612

PCT Pub. Date: Jul. 8, 1999

(30) Foreign Application Priority Data

Dec. 26, 1997 (JP) ..... 9-369031

(51) Int. Cl.[7] ..... B24B 1/00; B24B 7/00; B24B 57/00

(52) U.S. Cl. ..... 451/36; 451/41; 451/60; 451/72; 451/287; 451/288; 451/446

(58) Field of Search ..... 451/36, 41, 42, 451/59, 60, 63, 285, 286, 287, 288, 289, 290, 446

(56) References Cited

U.S. PATENT DOCUMENTS

| | | | | |
|---|---|---|---|---|
| 3,683,562 A | * | 8/1972 | Day | |
| 5,421,768 A | * | 6/1995 | Fujiwara et al. | 451/283 |
| 5,456,627 A | * | 10/1995 | Jackson et al. | 451/11 |
| 5,679,063 A | * | 10/1997 | Kimura et al. | 451/287 |
| 5,709,593 A | * | 1/1998 | Guthrie et al. | 451/287 |
| 5,957,757 A | * | 9/1999 | Berman | 451/56 |
| 6,106,375 A | * | 8/2000 | Furusawa | 451/67 |
| 6,139,406 A | * | 10/2000 | Kennedy et al. | 451/67 |
| 6,139,677 A | * | 10/2000 | Togawa et al. | 451/72 X |
| 6,149,508 A | * | 11/2000 | Vanell et al. | 451/72 |
| 6,193,587 B1 | * | 2/2001 | Lin et al. | 451/56 |

FOREIGN PATENT DOCUMENTS

| | | |
|---|---|---|
| JP | 61-188071 | 8/1986 |
| JP | 63-34580 | 9/1989 |
| JP | 63-61936 | 11/1989 |
| JP | 7-201786 | 8/1995 |
| JP | 7-223142 | 8/1995 |
| JP | 8-257899 | 10/1996 |
| JP | 9-57610 | 3/1997 |
| JP | 9-174420 | 7/1997 |

OTHER PUBLICATIONS

Patent Abstracts of Japan, Kuniyuki Shinpei et al., "Surface Plate Washing Device of Lapping Machine", Mar. 3, 1997.
Patent Abstracts of Japan, Fujiwara Yukio, et al., "Dressing Device Of Polishing Cloth", Jan. 13, 1995.

* cited by examiner

*Primary Examiner*—Timothy V. Eley
(74) *Attorney, Agent, or Firm*—Wenderoth, Lind & Ponack, L.L.P.

(57) ABSTRACT

This invention relates to a polishing machine for polishing an article such as a semiconductor wafer. A movable arm is located at a liquid supply position for supplying a liquid such as a polishing liquid onto a polishing surface of a turntable. The arm is also adapted to be moved to and held at a retracted position radially outside the polishing surface. At the liquid supply position, liquid supply nozzles supported on the arm are brought into a condition such that the nozzles are close to a position on the polishing surface where the liquid is to be supplied, whereby the liquid is accurately supplied onto the position. Holding the arm at the retracted position makes it easy to conduct a maintenance work for the polishing surface and so on.

32 Claims, 8 Drawing Sheets

POLISHING DEVICE

TECHNICAL FIELD

The present invention relates to a polishing machine comprising a turntable having a polishing surface for polishing a semiconductor wafer or the like, and a polishing liquid supply unit for supplying a polishing liquid onto the polishing surface of the turntable.

BACKGROUND OF THE INVENTION

In a semiconductor wafer manufacturing process, a polishing machine is used to planarize semiconductor wafer surfaces.

The polishing machine of the this kind comprises a turntable having a polishing surface and adapted to be turned at a predetermined rotating speed, a wafer carrier that holds a semiconductor wafer rotates at a predetermined rotating speed and presses a surface of the semiconductor wafer against the polishing surface of the turntable onto which a polishing liquid is being supplied so as to polish the surface of the semiconductor wafer, a dressing tool that is brought into contact with the polishing surface of the turntable while supplying a dressing liquid onto the polishing surface of the turntable to dress the polishing surface, and an airtight housing containing the turntable, the wafer carrier and the dressing tool therein.

As shown in FIG. 1, in a conventional polishing machine, a polishing surface of a turntable 201, which polishing surface is usually formed by attaching a polishing pad 202 to the upper surface of the turntable 201, is supplied with various kinds of liquids, including a polishing liquid and a dressing liquid which are needed for performing certain operations such as polishing of semiconductor wafers, dressing of the polishing surface and so on, through a nozzle 203 which is set above the turntable and connected to a liquid supply tube 205.

However, this conventional polishing machine has the following problems.

(1) The nozzle 203 and the liquid supply tube 205, which are fixedly held above the turntable 201 hinder maintenance work which includes replacing the polishing pad 202 attached to the upper surface of the turntable 201 with a new one.

(2) Although it is desired that the liquid discharged from the nozzle 203 falls onto the polishing surface of the turntable 201 at a position suitable for the liquid to be appropriately spread over the polishing surface of the turntable 201 by a centrifugal force, i.e., a position near the center of rotation of the turntable 201, the position on the polishing surface of the turntable 201 where the liquid falls may be different from such a desired position depending on the flow rate and velocity of the discharged liquid.

The present invention has been made in view of those problems and it is therefore an object of the present invention to provide a polishing machine with a liquid supply system that does not hinder maintenance work such as the exchange of polishing pads and is capable of positively supplying a liquid at an optimum position on a polishing surface of a turntable.

SUMMARY OF THE INVENTION

According to the present invention, a polishing machine is provided with a liquid supply system comprising a movable arm, and a nozzle supported on the movable arm to supply a liquid onto a polishing surface of a turntable.

The movable arm is movable between a liquid supply position whereby the nozzle is positioned substantially vertically above a portion of the polishing surface onto which the liquid is to be discharged, and at least one retracted position whereby the nozzle is positioned outside the periphery of the turntable. The polishing machine further comprises a holding device for holding the arm at either the liquid supply position or the retracted position.

DESCRIPTION OF THE PREFERRED EMBODIMENTS

The best mode embodiments of the present invention will be described hereinafter with reference to the accompanying drawings.

Figure 2:
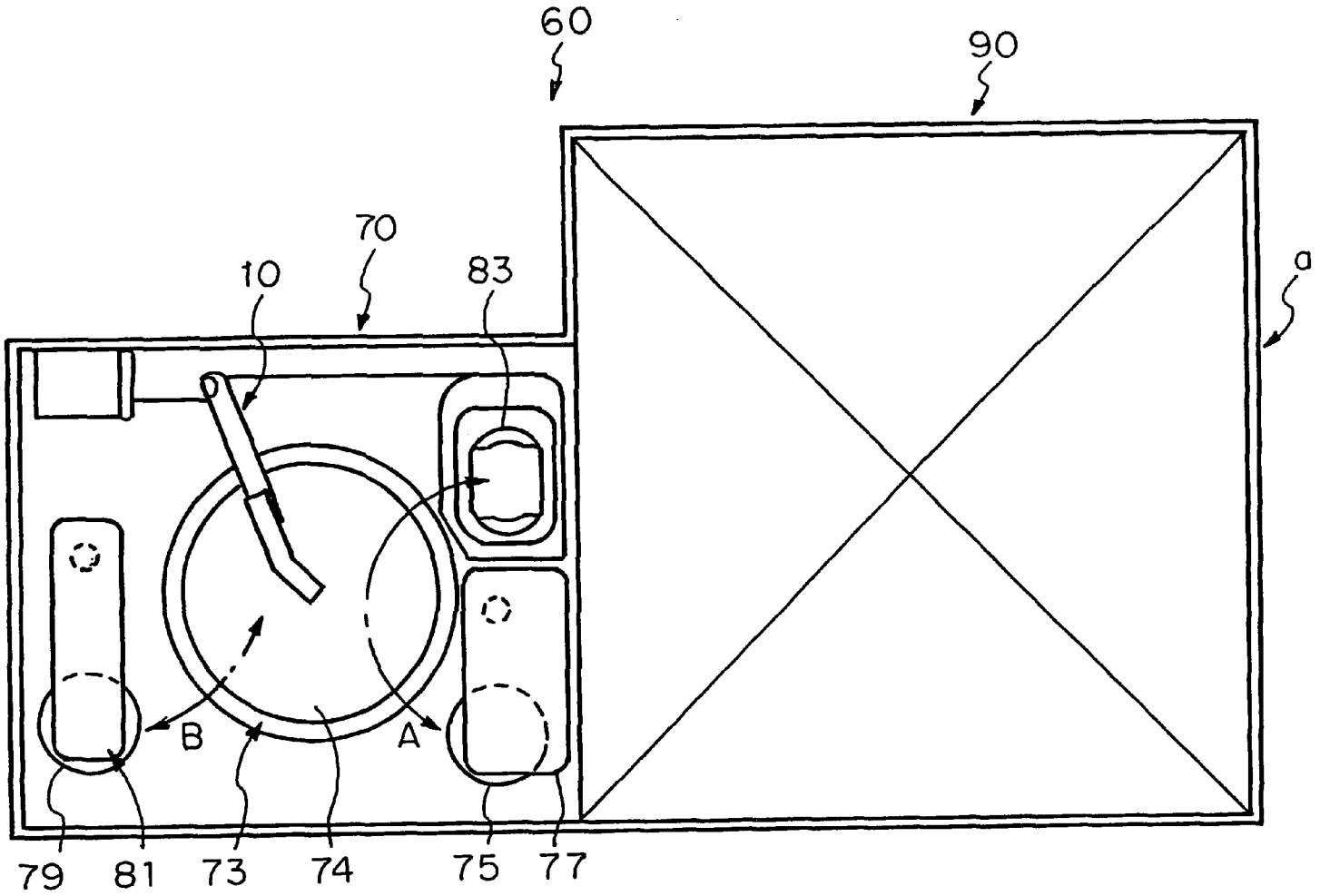
FIG. 2 is a schematic plan view of a polishing machine in a preferred embodiment of the present invention.

FIG. 2 shows a schematic view of an entire construction of a polishing machine 60 in accordance with an embodiment of the present invention. Referring to FIG. 2, the polishing machine 60 has a polishing unit 70 that performs a polishing operation, and a cleaning unit 90 contiguous with the polishing unit 70. The units 70 and 90 are contained in an airtight housing.

In the polishing unit 70, a turntable 73 is disposed at the center of the polishing unit 70, and a carrier assembly 77 and a dresser assembly 81 are respectively disposed on either side of the turntable 73. The carrier assembly 77 includes a wafer carrier 75 in the shape of a disk and capable of holding a wafer to be polished and of bringing the wafer into contact with a polishing surface of the turntable. The dresser assembly 81 includes a dressing tool 79 in the shape of a disk for dressing the polishing surface of the turntable 73. A workpiece transfer device 83 is disposed near the carrier assembly 77 to transfer a semiconductor wafer from the polishing unit 70 to the cleaning unit 90 and vice versa.

The polishing machine performs a polishing operation and a dressing operation as described below.

A semiconductor wafer to be polished is received through a delivery station a of the cleaning unit 90. The semiconductor wafer is carried through the cleaning unit 90 onto the workpiece transfer device 83 of the polishing unit 70.

The wafer carrier 75 of the carrier assembly 77 is turned from a position shown in FIG. 2 along a path indicated by an arrow A, picks up the wafer from the workpiece transfer device 83 to hold it on its lower surface, rotates about its axis while returning along the path indicated by the arrow A to a position above the turntable 73, and is then lowered to press the wafer against a polishing pad 74 attached to the upper surface of the turntable for the polishing operation. During the polishing operation, a polishing liquid is supplied onto the polishing pad 74 through a liquid supply arm 10.

After the polishing operation has been completed, the semiconductor wafer is returned to the work transfer device 83 so that the wafer is cleaned and dried by the cleaning unit 90 and, thereafter, taken outside through the delivery station a.

After the polishing operation has been completed, the dressing tool 79 is pressed against the polishing pad while being rotated about its axis and swung along the path designated by an arrow B over the turntable 73 so as to dress the polishing pad 74. During the dressing operation, a dressing liquid is supplied onto the polishing pad 74 through the liquid supply arm 10, the detail of which is explained hereinafter.

The polishing machine according to the embodiment is provided with a liquid supply system for supplying a polishing liquid, a dressing liquid and so on which will be described hereinafter. However, prior to describing the liquid supply system, a liquid draining system will briefly be explained as follows.

Figure 3:
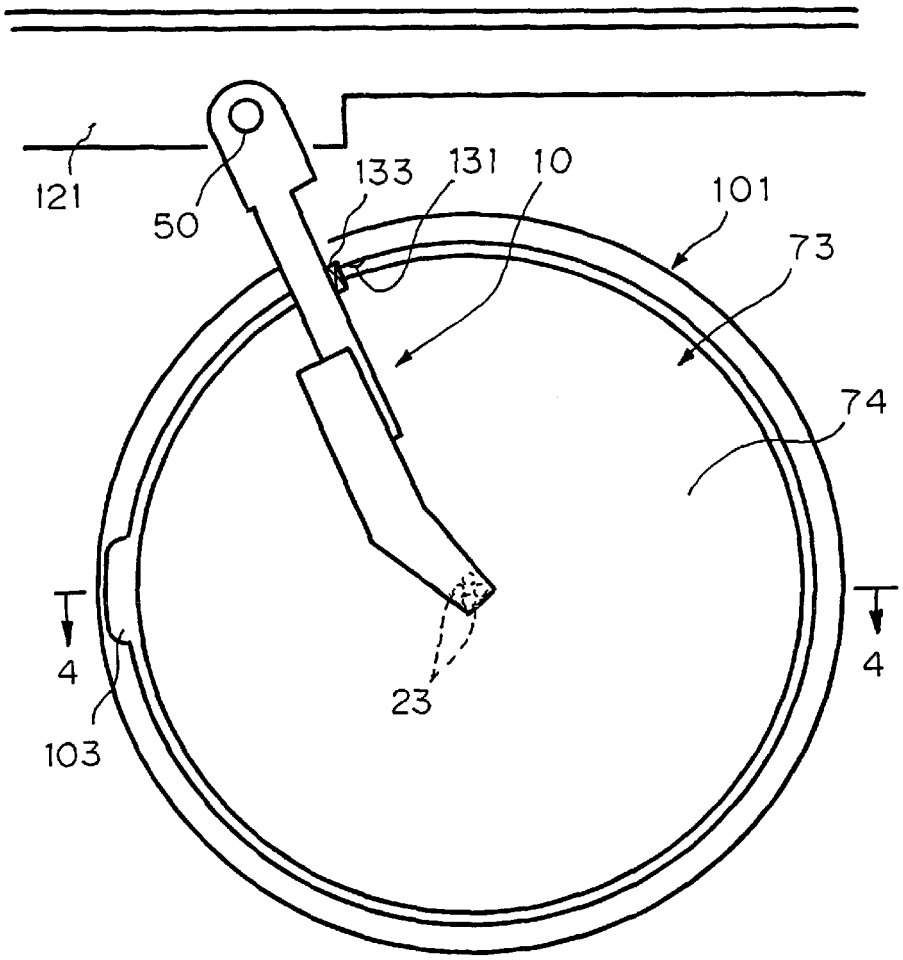
FIG. 3 is an enlarged plan view of a turntable and an arm with a liquid supply nozzle unit included in the polishing machine of the preferred embodiment.
Figure 4:
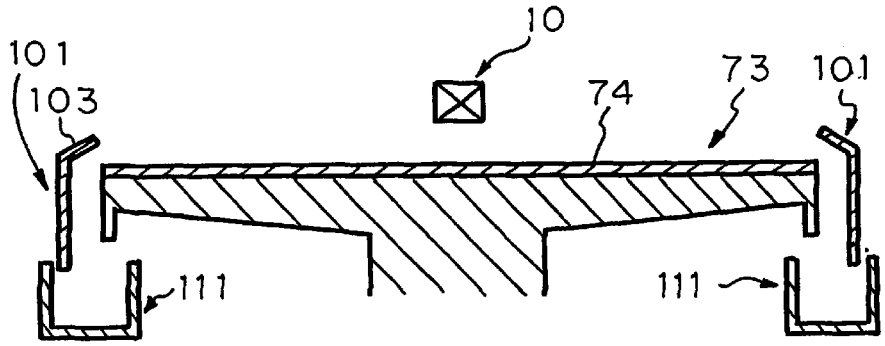
FIG. 4 is a schematic sectional view taken along a line 4—4 in FIG. 3.

Referring to FIGS. 3 and 4, the polishing machine according to the embodiment of the present invention is provided with a splash cover 101 to prevent a liquid such as the polishing liquid supplied onto the turntable 73 by the liquid supply system from scattering beyond the periphery of the turntable 73 as the turntable 73 is rotated. The splash cover 101 is provided with a notch 103. An annular trough 111 is disposed under the periphery of the turntable 73. The liquid stopped by the splash cover 101 is collected in the annular trough 111 and is drained from the polishing unit 70 through a drain pipe, not shown.

The liquid supply system will now be described. The liquid supply system includes the liquid supply arm 10. The liquid supply arm 10 has one end portion supported by a pivot shaft 50 on a frame 121. A nozzle assembly comprising four nozzles 23 for selectively discharging a polishing liquid or a dressing liquid is held on the other end portion of the liquid supply arm 10.

A detent mechanism 15 is provided near the pivot shaft 50 supporting the liquid supply arm 10. The detent mechanism 15 is able to selectively hold the liquid supply arm 10 at a liquid supply position F (the position shown in FIG. 3) for supplying the liquid, a first retracted position D close to the periphery of the turntable 73 or a second retracted position E radially separated from the periphery of the turntable 73.

Figure 7:
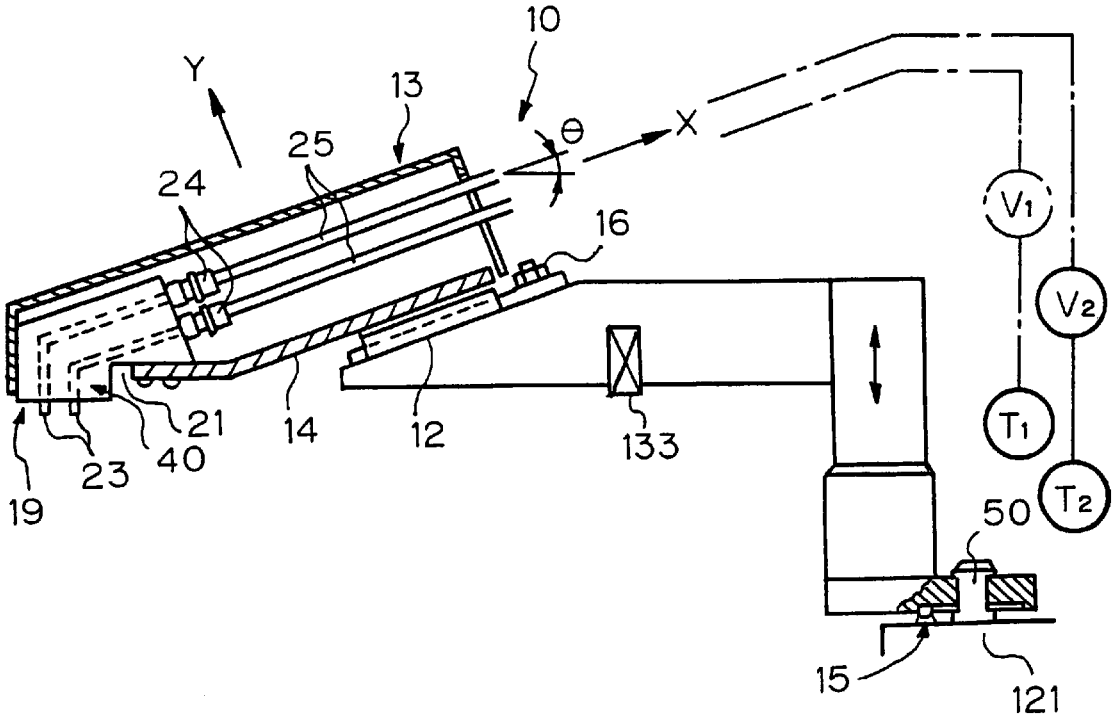
FIG. 7 is a partly cutaway side elevational view of the arm with the nozzle unit.

The liquid supply arm 10 has a slide mechanism 12 on the upper surface of its forward end portion, the slide mechanism including a slide member 14. The nozzle assembly 40 is fastened to a forward end portion of the slide member 14 with screws or the like. A cover 13 is detachably attached to the nozzle assembly 40 so as to cover the latter. As shown in FIG. 7, the liquid supply arm 10 can be moved vertically by a hydraulic or pneumatic piston-cylinder actuator.

The detent mechanism 15 comprises an elastic member disposed at a predetermined position on the frame 121, a ball pressed against the lower surface of the base end portion of the liquid supply arm 10 by the elastic member, and recesses formed in the lower surface of the base end portion of the liquid supply arm 10. The liquid supply arm 10 is held at the liquid supply position F, the first retracted position D or the second retracted position E when the ball engages with the corresponding one of the recesses. When a torque exceeding a predetermined value is applied to the liquid supply arm 10, the arm 10 can be released from the position where it was held by the detent mechanism.

The slide member 14 is supported for sliding on the slide mechanism 12. However, the slide member 14 is restrained from sliding off the slide mechanism 12 in a direction X by a detent mechanism similar to the detent mechanism 50.

The nozzle assembly has a nozzle holding member 40. A forward end portion of the nozzle holding member 40 projects downward from an opening 21 formed in a forward end portion of the lower wall of the cover 13. The nozzles 23 are held by the nozzle holding member 40 so that the distal end portions thereof project vertically downward from the lower surface 19 of the nozzle holding member 40. The proximal ends of the nozzles 23 are respectively connected to supply tubes 25 via connectors 24. If the distal ends of the nozzles 23 are flush with the lower surface 19, liquids such as a polishing liquid and dressing liquid discharged from the nozzles 23 have a tendency such that little quantities thereof remain on the lower surface 19 of the nozzle holding member 40 due to their surface tension, whereby a mixing of the remaining liquids or a contamination can result. However, in this embodiment, since the distal end portions of the nozzles 23 are projected from the lower surface 19 of the nozzle holding member 40 and are spaced apart from each other, such a mixing or contamination can be avoided.

While the four supply tubes 25 are extended out from the cover 13, they are inclined at a predetermined angle θ relative to a horizontal plane to prevent the liquids from remaining in the supply tubes 25.

A polishing liquid, a dressing liquid, a dispersant or cleaning liquid and chemical liquids such as an oxidizer liquid or the like may be supplied to the supply tubes 25, respectively. Specifically, the supply tubes 25 may be connected to different tanks T or sources of such liquids, respectively, as shown in FIG. 7. The number and construction of the nozzles 23 and the supply tubes 25 are determined as required.

The operation of the liquid supply arm 10 will be described hereinafter.

Figure 5:
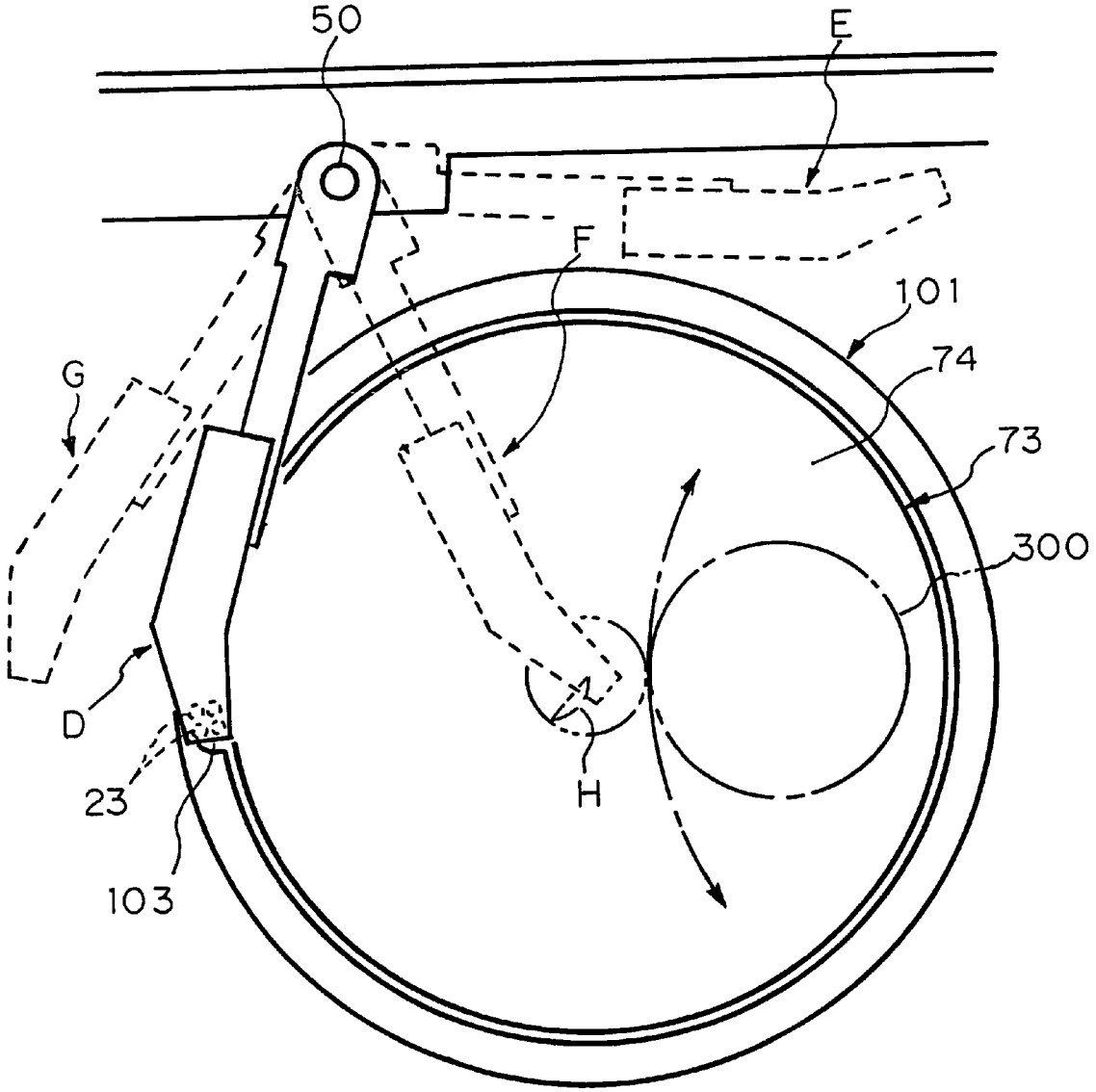
FIG. 5 is a plan view, similar to FIG. 3, showing a plurality of positions where the arm with the nozzle unit is positioned.

When the liquid supply arm 10 is located and held by the detent mechanism 15 at the liquid supply position F as shown in FIG. 5, the center of the arrangement of the four nozzles 23 coincides with the turning axis of the turntable 73. When polishing the semiconductor wafer by holding the semiconductor wafer on the lower surface of the wafer.

The polishing liquid thus discharged falls vertically on the central portion of the turntable 73, and is forced to spread uniformly over the entire surface of the turntable 73 by a centrifugal force.

When the dressing tool 79 is operated for a dressing operation, a dressing liquid is discharged through another nozzle 23 for the dressing liquid. The dressing liquid falls vertically on the central portion of the turntable 73 and is forced to spread uniformly over the entire surface of the polishing pad 74.

Figure 1:
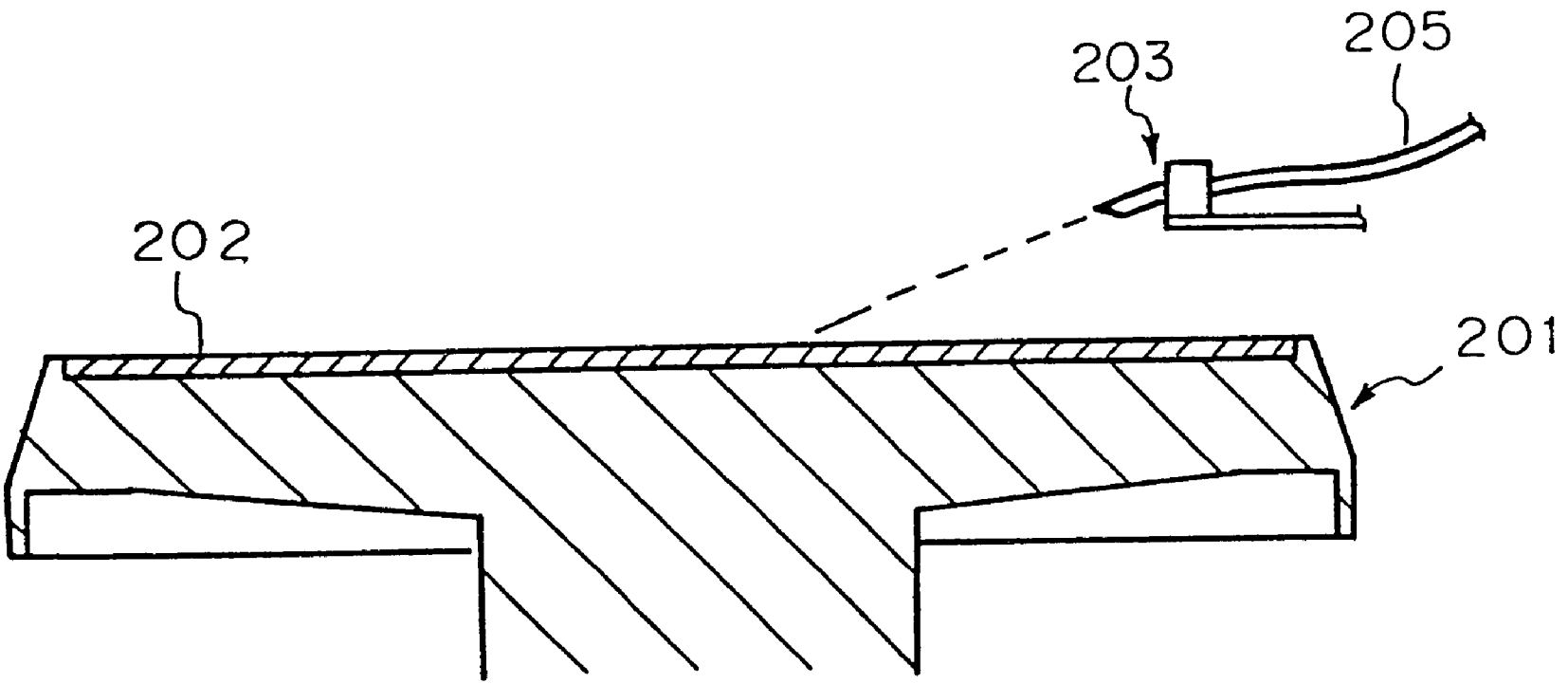
Fig. 1 PRIOR ART
FIG. 1 is a schematic side elevational view of an arrangement of a turntable and a nozzle in a conventional polishing machine.

While the nozzle in the conventional polishing machine as shown in FIG. 1 discharges a liquid obliquely onto the turntable, the nozzles 23 supported by the liquid supply arm discharge liquids vertically onto the central portion of the turntable 73 and, as a result, the liquids can be supplied accurately onto a desired region of the polishing surface of the turntable 73.

The liquids can be vertically supplied onto the turntable 73 by a different method without arranging the nozzles 23 to extend vertically as shown in FIG. 7. In the different method, flow regulating valves V are provided in the lines connecting the nozzles 23 and the tanks T storing the liquids to control the flow rates of the liquids supplied to the nozzles 23 so that the liquids discharged from the nozzles 23 will instantaneously fall vertically even if the tip end portions of the nozzles 23 are extended obliquely.

When replacing the polishing pad 74 attached to the upper surface of the turntable 73 with a new one, the liquid supply arm 10 is turned by hand to the first retracted position D shown in FIG. 5. The liquid supply arm 10 is then held stationary at the first retracted position D by the detent mechanism 15. Consequently, there is nothing immediately above the polishing pad 74 of the turntable 73, so that the replacement of the polishing pad 74 can easily be conducted.

During the polishing pad replacement operation, the nozzles 23 supported on the forward end portion of the liquid supply arm 10 located at the first retracted position D are positioned just above the notch 103 of the splash cover 101, whereby liquids which may remain inside and drop from the nozzles 23 after ceasing the supply of the liquids to the nozzles 23 fall through the notch 103 into the annular trough 111; and thus, the surroundings of the turntable 73 is not contaminated by the dropping liquids.

The drainage system also makes it possible that a pure water source is additionally connected to the tubes 25 so that pure water can be flowed through the tubes and nozzles after the supply of the polishing liquid, the dressing liquid and so on to clean the and nozzles without contaminating the surroundings of the turntable 73.

The liquid supply arm 10 is moved to the second retracted position E and held by the detent mechanism when it is necessary to carry out maintenance work of the polishing machine which cannot be done with the liquid supply arm 10 located at the liquid supply position F or the first retracted position D. The maintenance work includes dismounting the nozzle assembly 40 from an arm body 11 of the liquid supply arm to measure supply or discharging rates of the liquids discharged from the nozzles 23, removing pieces of a semiconductor wafer broken on the turntable 73, removing the splash cover 101 to remove the pieces of broken semiconductor wafer from the annular trough 111, inspecting the entire turntable 73 and repairing the liquid supply system, removing pieces of a semiconductor wafer broken on the turntable 73, removing the splash cover 101 to remove the pieces of broken semiconductor wafer from the annular trough 111, inspecting the entire turntable 73 and repairing the liquid supply system.

In this state, nothing overlies the turntable 73 and the splash cover 101 and hence the maintenance work can easily be conducted.

Since the second retracted position E is close to a side wall of the polishing unit 70, the maintenance of the liquid supply system can easily be performed from the outside of the polishing unit 70. A retracted position G shown in FIG. 5 may be used instead of the second retracted position E.

The discharging rate at which the liquid is discharged through each nozzle 23 must be measured to adjust the rate to an appropriate value. In this embodiment, the discharging rate is measured by either of the following two methods.

Figure 6:
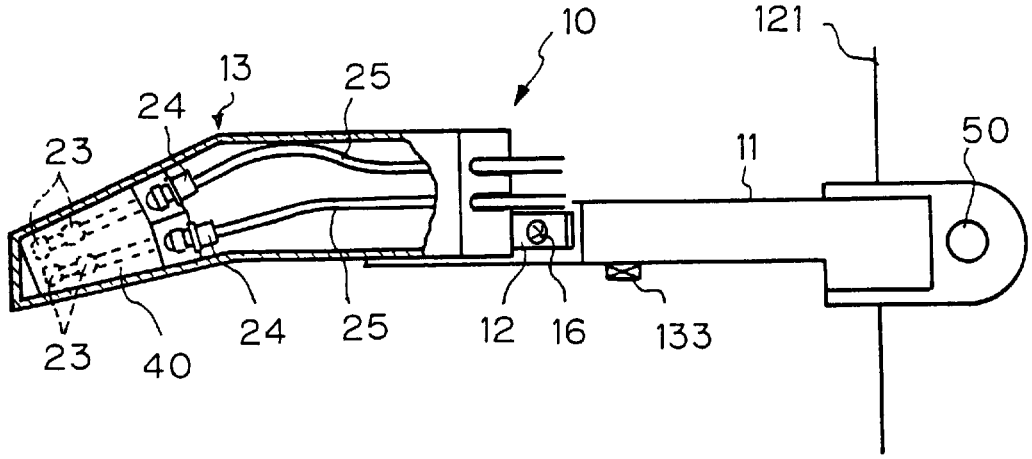
FIG. 6 is a partly cutaway plan view of the arm with the nozzle unit.

In a first measuring method, the liquid discharged from each nozzle 23 is directly measured by a graduated cylinder or the like. The measurement may be carried out by, for example, placing the liquid supply arm 10 at the first retracted position D or removing the nozzle unit 40 together with the slide member 14 from the liquid supply arm and placing it on a place convenient for the measurement. To remove the nozzle assembly from the arm 10, screws 16 (FIGS. 6 and 7) are first removed and then the nozzle assembly with the slide member 14 is moved in the direction X to thereby be separated from the arm.

In a second measuring method, the cover 13 is pulled in the direction designated by an arrow Y to remove the cover 13 from the slide member 14. The supply tubes 25 are then disconnected from the connector 24, the free end portions of the supply tubes 25 are moved to a place convenient for the measurement and, thereafter, the flow rates of the liquids discharged from the free ends are measured.

The second measuring method does not measure quantities of the liquids discharged from the nozzles 23. Therefore, it is possible that a discharging rate measured by the second measuring method may include an error greater than an error which may be included in the measurement by the first measuring method. However, the second measuring method is more convenient and simpler than the first measuring method where slide member 14 and associated elements are removed from the arm body 11 of the liquid supply arm.

In this embodiment, the liquid supply arm 10 is turned on the pivot shaft 50 and the position of the liquid supply arm 10 can easily be detected by a position sensor combined with the pivot shaft 50. Therefore, it is possible to improve the polishing machine in terms of safety by providing an interlocking mechanism which controls the drive of the polishing machine so that, when it is detected that the liquid supply arm is not appropriately located at the liquid supply position F in a polishing operation, the driving of the polishing machine is stopped. For example, it is possible to avoid damaging the liquid supply arm 10 and the dressing unit 81 by a collision therebetween which may be brought about by a turn of the dressing unit 81 about its pivot shaft when the liquid supply arm 10 is at a position out of the liquid supply position F.

As shown in FIG. 3, a dog 131 is attached to the splash cover 101 at a predetermined position, and a sensor 133 is attached to the arm body 11 at a position which is close to and opposite the dog 131 when the splash cover 101 is set correctly in place (FIGS. 1 and 3) so that it is easy to determine whether the splash cover is set correctly or not. The splash cover 101 is vertically movable and is lowered when performing the maintenance of the turntable 73. If the polishing operation is performed with the splash cover 101 lowered, the polishing liquid and such are scattered around. A drive motor for driving the turntable 73 is therefore adapted to be prevented from being activated when the splash cover 101 is lowered and thus the sensor 133 does not detect the dog 131.

Further, it is possible to lower the splash cover 101 to the predetermined regular position or to raise the arm body 11 by a predetermined distance when the splash cover 101 is raised excessively so that it becomes impossible for the sensor 133 to detect the dog 131. Although in this embodiment both of the arm body 11 and the splash cover 101 are made to be vertically movable, it is possible for the arm body 11 not to move vertically.

The polishing machine in this embodiment has three positions where the liquid supply arm 10 can be held stationary by the detent mechanism 15. However, this invention is not limited to such an arrangement. The polishing machine may have at least one liquid supply position and at least one retracted position.

If the liquid supply arm 10 is arranged to be turned by a piston-cylinder actuator provided between the fixed frame of the polishing machine and the liquid supply arm 10, any mechanism like the detent mechanism 15 for holding the liquid supply arm 10 stationary is not needed. When such a piston-cylinder actuator is employed, a position sensing switch may be associated with the piston-cylinder actuator to sense and control the position of the liquid supply arm 10. A rotary actuator may be employed instead of the piston-cylinder actuator. Further, if the liquid supply arm 10 is driven for turning by a stepping motor, the liquid supply arm 10 can accurately be stopped and held at desired positions without any detent mechanism.

In this embodiment, the liquid supply position F is such a position that makes the center of the arrangement of the four nozzles 23 in the forward end portion of the liquid supply arm 10 coincide with the turning axis of the turntable 73. However, the liquid supply position F is not limited to such a position. For example, when the periphery of a semiconductor wafer 300 is not moved to the center of the turntable 73 in the polishing operation, the center of the arrangement of the four nozzles 23 may, as shown in FIG. 5, be located at any position in a circular center area of the polishing pad having a radius H which is not used for polishing the semiconductor wafer 300. This is because the liquid supplied onto such a circular center area will be appropriately spread over the polishing pad and supplied to the semiconductor wafer 300 which is being polished.

In the second embodiment, a liquid supply arm 10' includes fixed nozzles 23' fixedly held on a forward end portion of a body 11' of the arm 10', and a movable nozzle 23" longitudinally movably supported on the arm body 11'. The fixed nozzles 23' are formed from a tip or free end portions of tubes 25' connected to liquid supply sources including a dressing liquid source (not shown). The free end portions of the tubes 25' are passed through vertical through holes formed in the forward end portion of the liquid supply arm 10' and secured to the liquid supply arm 10' by a fixing member 27. The movable nozzle 23" is formed from a tip or free end portion of a tube 25" connected to a polishing liquid source (not shown). The free end portion of the tube 25" is passed vertically through longitudinal slots 28 formed in the arm body 11' and is held at a desired position by a movable fixing device 30. More specifically, the arm body 11' is a tubular member having a circular cross section and the longitudinal slots 28 are diametrically opposite each other in the vertical direction. The movable fixing device 30 includes a sliding member 32 which has a substantially circular cross section and is longitudinally slidably fitted in the arm body 11', a tube holding member 36 positioned below a lower surface of the arm body 11', and a bolt 34 which passes through the longitudinal slots 28 in the vertical direction and is threadably engaged with the tube holding member 36. The free end portion of the tube 25" passing through the slots 28 is fastened to the tube holding member 36 by a fastening member 38.

The bolt 34 is passed through a vertical hole formed in the sliding member 32 and is threadably engaged with a threaded hole formed in the tube holding member 36. The tube holding member 36 can thus be lifted and lowered relative to the arm body 11' by turning the bolt 34 about its axis so that the sliding member 32 is fixedly engaged with and disengaged from the arm body.

Figure 8:
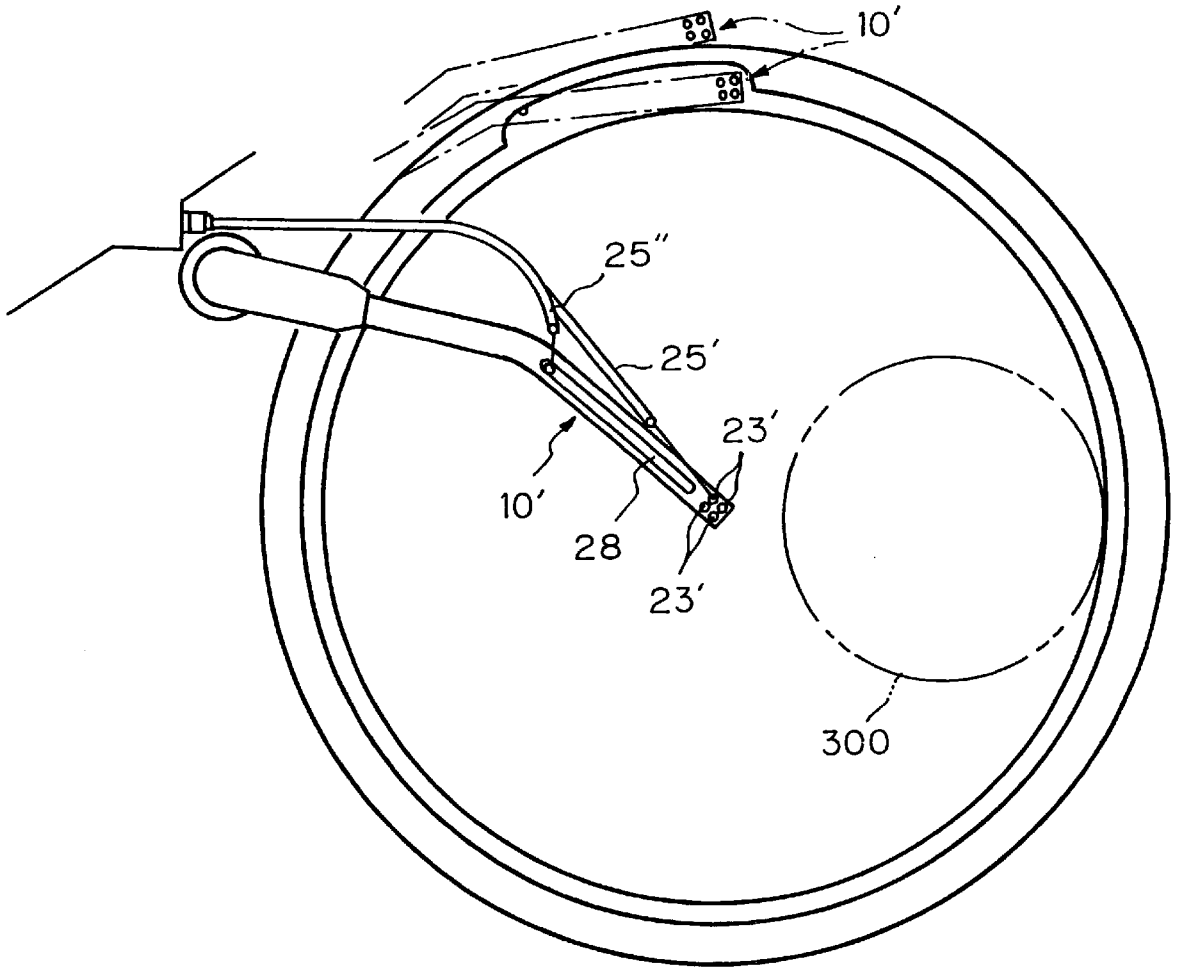
FIG. 8 is a plan view of an arm with the nozzle unit in accordance with a second embodiment of the present invention.
Figure 9:
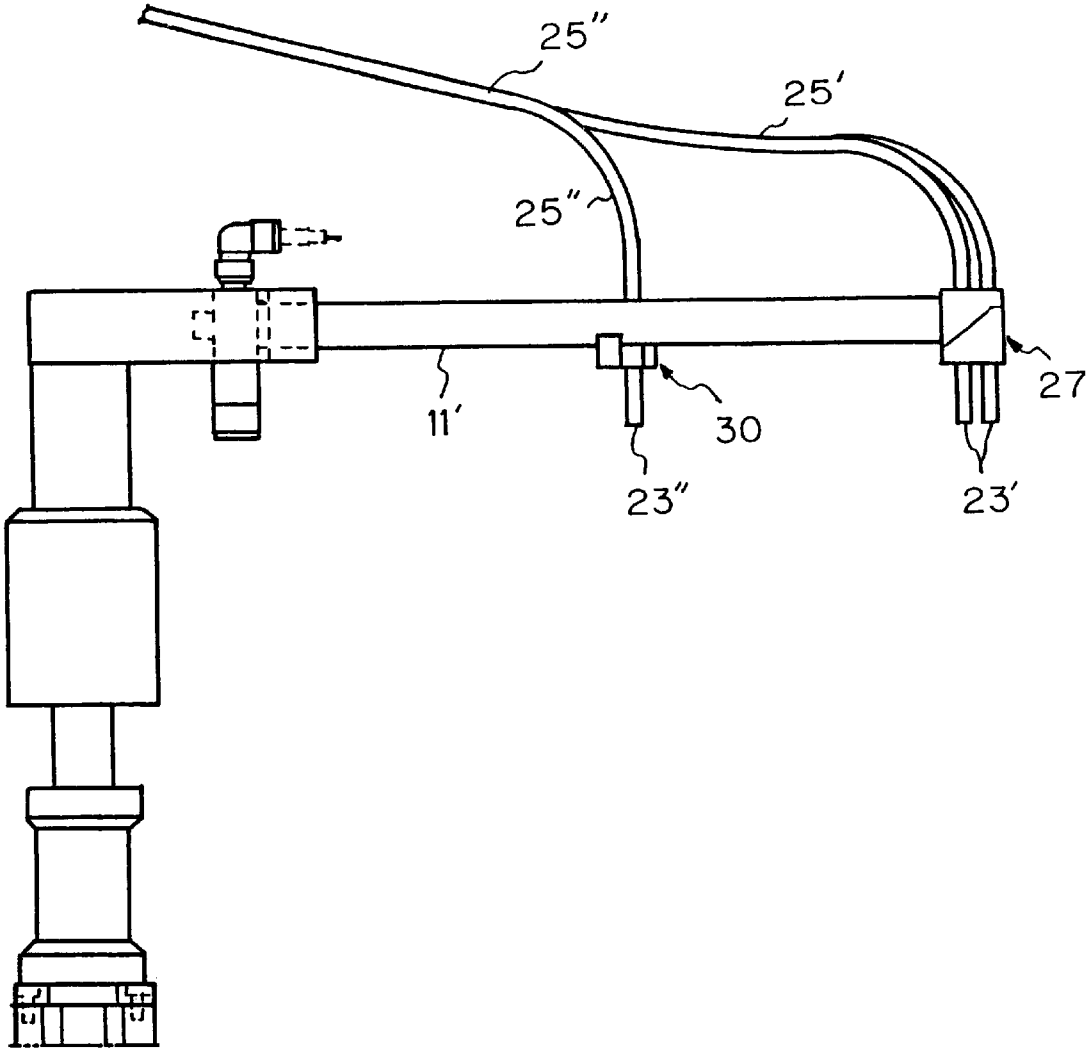
FIG. 9 is a side elevation of the arm shown in FIG. 8.
Figure 10:
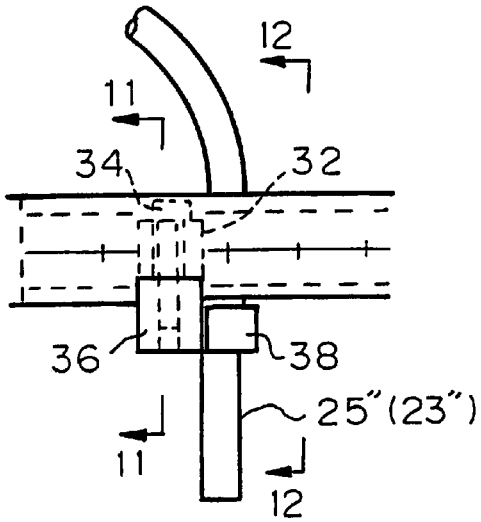
FIG. 10 is a side elevational view of a movable nozzle included in the nozzle unit of the arm shown in FIG. 9.
Figure 11:
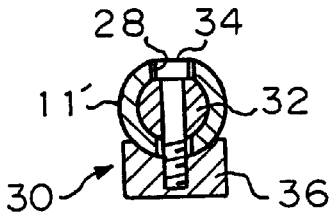
FIG. 11 is a sectional view taken along a line 11—11 in FIG. 10.
Figure 12:
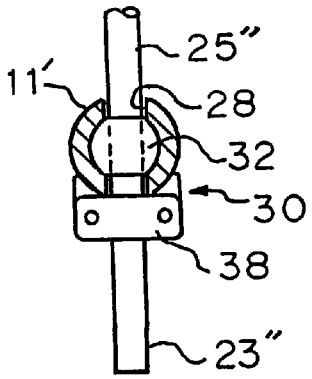
FIG. 12 is a sectional view taken along a line 12—12 in FIG. 10.

In the embodiment shown in FIG. 8, the movable nozzle 23" is located at a radial position on the polishing surface of the turntable corresponding to the center of a wafer 300 which is being subjected to the polishing operation, while the fixed nozzles are positioned at the center of the polishing surface of the turntable. Although, in this embodiment, only the nozzle for discharging a polishing liquid is made to be movable, any other nozzles may be made to be movable as required. For example, it is preferable that the nozzles for discharging a dispersant liquid and the nozzle for discharging an oxidizer liquid are movable so that those nozzles can be located at the same position as the polishing liquid.

INDUSTRIAL APPLICABILITY

As is apparent from the foregoing description, according to the present invention, (1) since the liquid supply arm can be located outside the turntable as required, the maintenance work which includes changing the polishing pads can easily be carried out without being hindered by the liquid supply arm, thereby shortening the time for the maintenance operation and, (2) since the liquids discharged from the nozzles are directed vertically, the liquids can be appropriately supplied onto a desired position on the turntable.

What is claimed is:

1. A method for polishing a workpiece, comprising:

providing a polishing surface;

bringing a workpiece into contact with said polishing surface; and supplying a polishing liquid onto said polishing surface at a desired position of said polishing surface, wherein said polishing liquid is supplied onto said polishing surface by being discharged from a nozzle provided on an arm, and said polishing liquid is supplied at the desired position of said polishing surface by holding said arm with a detent mechanism such that said nozzle discharges said polishing liquid at the desired position.

2. The method according to claim 1, wherein the desired position substantially corresponds to a center of said workpiece.

3. The method according to claim 1, wherein the desired position substantially corresponds to a center of said polishing surface.

4. The method according to claim 1, wherein said workpiece comprises a semiconductor wafer.

5. A polishing machine comprising:

a polishing surface;

a liquid supply system for supplying a liquid onto said polishing surface, wherein said liquid supply system includes (i) an arm, and (ii) a nozzle supported on said arm to discharge the liquid onto said polishing surface, wherein said arm is movable between a liquid supply position at which said nozzle is positioned substantially vertically above a portion of said polishing surface onto which the liquid is to be discharged, and at least one retracted position at which said nozzle is positioned outside of a periphery of said polishing surface;

a stationary member; and a detent mechanism, provided between said stationary member and said arm, for holding said arm at the liquid supply position and the at least one retracted position, respectively, wherein said detent mechanism includes (i) an elastic member disposed on said stationary member, (ii) a ball that is pressable against said arm by said elastic member, and (iii) recesses formed in said arm such that said detent mechanism is to hold said arm at the liquid supply position by pressing said ball with said elastic member such that said ball becomes engaged with one of said recesses, and is to hold said arm at the at least one retracted position by pressing said ball with said elastic member such that said ball becomes engaged with another one of said recesses, and such that said ball can be disengaged from the one of said recesses and the another one of said recesses by applying a predetermined force against said arm, whereby said arm can be moved between the liquid supply position and the at least one retracted position.

6. The polishing machine according to claim 5, wherein said liquid supply system further includes a flow regulating device to regulate a flow rate of the liquid such that the liquid discharged from said nozzle flows substantially vertically down onto the portion of said polishing surface.

7. The polishing machine according to claim 5, wherein said arm is also vertically movable.

8. The polishing machine according to claim 5, wherein said liquid supply system includes additional nozzles, with said nozzle and said additional nozzles to be respectively connected to different kinds of liquid sources.

9. The polishing machine according to claim 8, wherein the different kinds of liquid sources to which said nozzle and said additional nozzles are to be respectively connected include a source of a polishing liquid, a source of a dressing liquid, a source of a dispersant liquid and a source of a chemical liquid.

10. A polishing machine comprising:

a polishing surface;

a liquid supply system for supplying a liquid onto said polishing surface, wherein said liquid supply system includes (i) an arm, and (ii) a nozzle supported on said arm to discharge the liquid onto said polishing surface, wherein said arm is movable between a liquid supply position at which said nozzle is positioned substantially vertically above a portion of said polishing surface onto which the liquid is to be discharged, and at least one retracted position at which said nozzle is positioned outside of a periphery of said polishing surface; and a splash cover that is movable between an upper position to prevent the liquid supplied onto said polishing surface from scattering beyond the periphery of said polishing surface, and a lower position that is below a level of said polishing surface.

11. The polishing machine according to claim 10, further comprising a liquid drainage member disposed under said splash cover to receive the liquid that drops from said splash cover after being scattered from said polishing surface and against said splash cover.

12. The polishing machine according to claim 10, wherein said splash cover is provided with a dog, and said arm is provided with a position sensor for sensing said dog.

13. The polishing machine according to claim 10, further comprising a sensor for determining whether said splash cover is located at the upper position.

14. A polishing machine comprising:

a polishing surface;

a liquid supply system for supplying a liquid onto said polishing surface, wherein said liquid supply system includes (i) an arm, and (ii) a nozzle supported on said arm to discharge the liquid onto said polishing surface, wherein said arm is movable between a liquid supply position at which said nozzle is positioned substantially vertically above a portion of said polishing surface onto which the liquid is to be discharged, and at least one retracted position at which said nozzle is positioned outside of a periphery of said polishing surface, and wherein said nozzle is movable along a length of said arm such that the position of said nozzle relative to said polishing surface can be adjusted when said arm is at the liquid supply position.

15. The polishing machine according to claim 14, wherein said liquid supply system includes additional nozzles, with said nozzle and said additional nozzles to be respectively connected to different kinds of liquid sources.

16. A polishing machine comprising:

a polishing surface;

a liquid supply system for supplying a liquid onto said polishing surface, wherein said liquid supply system includes (i) an arm, and (ii) a nozzle supported on said arm to discharge the liquid onto said polishing surface, wherein said arm is movable between a liquid supply position at which said nozzle is positioned substantially vertically above a portion of said polishing surface onto which the liquid is to be discharged, and at least one retracted position at which said nozzle is positioned outside of a periphery of said polishing surface, and wherein said nozzle includes a proximal end and a downwardly vertically extending distal end through which the liquid is to be discharged onto the portion of said polishing surface; and wherein said liquid supply system includes a liquid supply tube which is detachably connectable to said proximal end of said nozzle such that said liquid supply tube slants upwardly from said proximal end when said liquid supply tube is connected to said proximal end.

17. A polishing machine comprising:

a polishing surface;

a liquid supply system for supplying a liquid onto said polishing surface, wherein said liquid supply system includes (i) an arm, (ii) nozzles supported on said arm to discharge the liquid onto said polishing surface, wherein said arm is movable between a liquid supply position at which said nozzle is positioned substantially vertically above a portion of said polishing surface onto which the liquid is to be discharged, and at least one retracted position at which said nozzle is positioned outside of a periphery of said polishing surface, and wherein said nozzles are respectively connectable to different kinds of liquid sources, and (iii) a nozzle mount member for removably mounting said nozzles on said arm, with said nozzle mount member including a lower surface, wherein said nozzles extend through said nozzle mount member such that distal ends of said nozzles extend downwardly beyond said lower surface with the distal ends being separated from each other.

18. A polishing machine comprising:

a polishing surface;

a liquid supply system for supplying a liquid onto said polishing surface, wherein said liquid supply system includes (i) an arm, (ii) a nozzle supported on said arm to discharge the liquid onto said polishing surface, wherein said arm is movable between a liquid supply position at which said nozzle is positioned substantially vertically above a portion of said polishing surface onto which the liquid is to be discharged, a liquid emptying position at which said nozzle is positioned outside of a periphery of said polishing surface, and a retracted position at which said nozzle is positioned outside of the liquid emptying position, and (iii) a detent mechanism for holding said arm at the liquid supply position, the liquid emptying position and the retracted position.

19. The polishing machine according to claim 18, further comprising a splash cover that is movable between an upper position to prevent the liquid supplied onto said polishing surface from scattering beyond the periphery of said polishing surface, and a lower position that is below a level of said polishing surface.

20. The polishing machine according to claim 19, further comprising a liquid drainage member disposed under said splash cover to receive the liquid that drops from said splash cover after being scattered from said polishing surface and against said splash cover, with said liquid drainage member also being adapted to receive the liquid that is emptied from said nozzle when said arm is positioned at the liquid emptying position.

21. The polishing machine according to claim 18, wherein said liquid supply system includes additional nozzles, with said nozzle and said additional nozzles being respectively connectable to different kinds of liquid sources.

22. The polishing machine according to claim 21, wherein said nozzle and said additional nozzles are also connectable to a source of pure water via selector valves such that said nozzle and said additional nozzles can be cleaned by passing pure water therethrough.

23. The polishing machine according to claim 18, wherein said liquid supply system further includes a flow regulating device to regulate a flow rate of the liquid such that the liquid discharged from said nozzle flows substantially vertically down onto the portion of said polishing surface.

24. The polishing machine according to claim 18, wherein said arm is also vertically movable.

25. The polishing machine according to claim 18, wherein said liquid supply system includes additional nozzles, with said nozzle and said additional nozzles being arranged such that distal end portions thereof extend vertically downwardly.

26. The polishing machine according to claim 18, further comprising:

a stationary member;

a piston-cylinder actuator provided between said stationary member and said arm such that said arm is movable by said piston-cylinder actuator; and a position sensing switch for sensing a position of said arm such that a position control of said arm can be conducted.

27. The polishing machine according to claim 18, further comprising a stepping motor for moving said arm such that said stepping motor conducts a position control of said arm.

28. A polishing machine comprising:

a polishing surface with which a workpiece is to be brought into contact so as to polish the workpiece; and a liquid supply system for supplying a polishing liquid onto said polishing surface, wherein said liquid supply system includes (i) a nozzle adapted to be connected to a source of a polishing liquid such that the polishing liquid can be discharged from said nozzle onto said polishing surface at a desired position thereof, (ii) an arm to support said nozzle, and (iii) a detent mechanism for holding said arm such that the polishing liquid can be discharged from said nozzle onto said polishing surface at the desired position thereof.

29. The polishing machine according to claim 28, wherein the desired position substantially corresponds to a center of the workpiece when the workpiece is brought into contact with said polishing surface.

30. The polishing machine according to claim 28, wherein the desired position substantially corresponds to a center of said polishing surface.

31. The polishing machine according to claim 28, wherein said polishing surface with which a workpiece is to be brought into contact so as to polish the workpiece comprises a polishing surface with which a semiconductor wafer is to be brought into contact so as to polish the semiconductor wafer.

32. A polishing machine comprising:

a polishing surface;

a liquid supply system for supplying a liquid onto said polishing surface, wherein said liquid supply system includes (i) a tube having a distal end and a proximal end, with said proximal end being adapted to be connected to a source of a polishing liquid, and with a nozzle being provided at said distal end, wherein said nozzle is movable such that a position of said nozzle relative to said polishing surface can be adjusted, and (ii) an arm on which said nozzle is provided, with said nozzle being movable along a longitudinal direction of said arm to adjust the position of said nozzle relative to said polishing surface.

* * * * *

UNITED STATES PATENT AND TRADEMARK OFFICE

CERTIFICATE OF CORRECTION

PATENT NO. : 6,338,669
DATED : January 15, 2002
INVENTOR(S) : Tetsuji Togawa et al.

It is certified that error appears in the above-identified patent and that said Letters Patent is hereby corrected as shown below:

Title page, Item [54], and column 1,
Change "POLISHING DEVICE" to -- POLISHING MACHINE --.

Signed and Sealed this

Twenty-first Day of May, 2002

*Attest:*

*Attesting Officer*

JAMES E. ROGAN
*Director of the United States Patent and Trademark Office*